US006416271B1

(12) United States Patent
Pigott et al.

(10) Patent No.: US 6,416,271 B1
(45) Date of Patent: Jul. 9, 2002

(54) DROP BOX CONTAINER

(75) Inventors: Maurice J. Pigott, Winnetka; Peter S. Pigott; Brandon L. Pigott, both of Wilmette; Schuyler F. Pigott; Michel Trapp, both of Arlington Heights, all of IL (US)

(73) Assignee: Nucon Corporation, Deerfield, IL (US)

( * ) Notice: Subject to any disclaimer, the term of this patent is extended or adjusted under 35 U.S.C. 154(b) by 0 days.

(21) Appl. No.: 09/545,797

(22) Filed: Apr. 7, 2000

(51) Int. Cl.[7] ..... B65G 21/02; B65G 69/00

(52) U.S. Cl. ..... 414/422

(58) Field of Search ..... 414/422

(56) References Cited

U.S. PATENT DOCUMENTS

| | | | | |
|---|---|---|---|---|
| 78,022 A | | 5/1868 | Smith | |
| 2,457,841 A | | 1/1949 | Smith et al. | |
| 2,690,277 A | * | 9/1954 | Shea et al. | 222/185.1 |
| 3,127,084 A | | 3/1964 | Williams | |
| 3,217,912 A | | 11/1965 | McKeon | |
| 3,318,473 A | | 5/1967 | Jones et al. | |
| 3,797,878 A | | 3/1974 | Fagre et al. | |
| 3,799,409 A | | 3/1974 | Goerke | |
| 3,883,005 A | * | 5/1975 | Stevens | 220/4.03 |
| 3,968,895 A | | 7/1976 | Barnes, Jr. et al. | |
| 4,186,841 A | | 2/1980 | Buckley et al. | |
| 4,210,273 A | | 7/1980 | Hegele | |
| 4,247,021 A | | 1/1981 | Renier et al. | |
| 4,300,695 A | | 11/1981 | Hsu | |
| 4,509,433 A | | 4/1985 | Farr | 108/52.1 |
| 4,662,532 A | * | 5/1987 | Anderson et al. | 220/1.5 |
| 4,674,647 A | | 6/1987 | Gyenge et al. | |
| 4,735,153 A | | 4/1988 | Wong | |

(List continued on next page.)

FOREIGN PATENT DOCUMENTS

| | | | | |
|---|---|---|---|---|
| DE | 2220124 | | 11/1972 | |
| DE | 3514930 | * | 10/1986 | B65D/88/54 |
| EP | 385914 A1 | | 9/1990 | |
| FR | 2752220 | | 2/1998 | |
| JP | 6321239 | | 11/1994 | |
| JP | 7257579 | | 10/1995 | |
| JP | 7257743 | | 10/1995 | |
| JP | 7257744 | | 10/1995 | |
| WO | WO 8203057 | | 9/1982 | |
| WO | WO 99/13760 | * | 3/1999 | A47K/10/24 |
| WO | WO 99/19219 | | 4/1999 | |

OTHER PUBLICATIONS

International Search Report, mailed on Nov. 7, 2001.
Brochure entitled "The Ultimate"; Allibert Contico, Bridgeton, Missouri.

*Primary Examiner*—Christopher P. Ellis
*Assistant Examiner*—Kenneth W Bower
(74) *Attorney, Agent, or Firm*—Wellenstein & Wagner, Ltd.

(57) ABSTRACT

A new drop box assembly or container having a base frame, a pair of runners to elevate the base frame from a surface, a first pair of door panels attached along one edge to the base frame, a sleeve having a plurality of sidewalls, and a top frame is disclosed. The base frame is preferably designed with a plurality of side members configured to define an opening, and a channel seated within the side members and circumjacent the opening—an upper surface of each side member being sloped away from the channel and toward the opening. Engagement of the disclosed container by a forklift or the like from four directions is permissible. A first means for securing the sleeve within the channel of the base frame includes a plurality of connecting members on one of either the base frame or the sleeve. Such connecting members include a plurality of male connecting members on the sleeve and a plurality of corresponding female connecting members on the base frame. An optional pair of short door panels may be included to assist flow direction of the discharging material. Compaction of the preferred container allows space efficiencies during shipping and storage of the empty container to be realized.

40 Claims, 12 Drawing Sheets

U.S. PATENT DOCUMENTS 4,735,331 A 4/1988 Keenan et al.
4,765,480 A 8/1988 Malmanger
4,775,068 A 10/1988 Reiland et al.
4,804,082 A 2/1989 Stein
4,917,255 A 4/1990 Foy et al.
5,011,360 A 4/1991 Abram et al.
5,094,356 A 3/1992 Miller
5,114,037 A 5/1992 Hillis et al.
5,415,311 A * 5/1995 Coogan ..... 206/600
5,441,321 A 8/1995 Karpisek
5,531,360 A 7/1996 Berdel et al.
5,579,686 A * 12/1996 Pigott et al. ..... 108/56.1
5,687,881 A 11/1997 Rouse et al. ..... 222/185.1
5,730,295 A * 3/1998 Darby ..... 108/53.5
5,746,463 A 5/1998 Nagata
5,868,080 A 2/1999 Wyler et al.
5,897,152 A 4/1999 Nagata
5,947,312 A 9/1999 Elstone
5,997,817 A 12/1999 Crismore et al.
6,138,863 A * 10/2000 Aiken ..... 220/819
6,305,566 B1 * 10/2001 Pigott et al. ..... 206/449

* cited by examiner

DROP BOX CONTAINER

TECHNICAL FIELD

The present invention relates to the field of containers for bulk material. Particularly, the present invention relates to an improved and reusable drop box assembly or container for accepting, storing, stacking, transporting, and automatically discharging solid bulk material.

BACKGROUND OF THE INVENTION

In the shipping and handling of solid bulk materials it has become the standard practice to use dispensing types of bins, called drop boxes, drop containers, or the like. These specialized containers permit less necessary handling and prevent the loss of contents due to spillage.

Many prior art containers exist to provide a bottom discharge for solid bulk materials. For example, U.S. Pat. No. 3,318,473 to Jones et al., U.S. Pat. No. 3,799,409 to Goerke, U.S. Pat. No. 4,210,273 to Hegele, and U.S. Pat. No. 5,441,321 to Karpisek teach use of containers which can be opened at the bottom side to discharge contents. Each of these devices requires some form of physical manipulation by an operator after the container has been positioned to discharge the subject material. The invention of the '473 patent utilizes a slidable gate which is pulled to an open position to commence dispensing. The '409 patent is very similar, requiring the operator to pull a sheet 32 to expose an opening. The '273 patent teaches the use of release straps, which when pulled permit the bottom of the container to open completely. The invention of the '321 patent uses latch means 50 to release a hinged door.

Other prior art devices teach mechanical manipulation of a chute or locking mechanism to permit the contents discharge. Such mechanical features are shown in U.S. Pat. No. 3,217,912 to McKeon, U.S. Pat. No. 3,797,878 to Fagre et al., U.S. Pat. No. 5,011,360 to Abram et al., U.S. Pat. No. 5,746,463 to Nagata, and U.S. Pat. No. 5,897,152 to Nagata. Such devices are complex, with many moving parts which may become jammed, damaged, or otherwise inoperable over time.

Still other devices, such as shown in U.S. Pat. No. 3,127,084 to Williams, have a single pair of simple hinged doors which swing open to discharge the contents of the container. However, because each of the doors is capable of a complete 90° pivot, there is a great possibility for the contents to be spilled from the opening. International Publication No. WO 99/19219 of PCT/GB98/03028 shows a pallet base having downwardly opening doors of less than 90°. However, the invention disclosed is limited to a mechanical base and does not provide the numerous advantages of an integrated assembly as disclosed herein.

The present invention provides bins constructed to be light and compact so as to be capable of stacking and economically shipping. These bins also facilitate handling with a minimum of equipment and maneuvering, and are capable of automatically discharging the contents of the bin by gravity into a wide variety of receptacles, vehicles, and the like. Further, the bins are capable of compaction into a small, substantially flat unit when emptied for return shipping.

The present invention addresses these shortcomings of the prior art to provide a reusable, stackable container for storage, transportation, and discharge of a bulk material.

SUMMARY OF THE INVENTION

In accordance with the present invention, a new drop box container having a base frame, a pair of runners to elevate the base frame from a surface, a first pair of door panels attached along one edge to the base frame, a sleeve having a plurality of sidewalls, and a top frame is disclosed. The base frame is preferably designed with a plurality of side members configured to define an opening, and a channel seated within the side members and circumjacent the opening—an upper surface of each side member being sloped away from the channel and toward the opening. It is an aspect of the present invention to allow engagement of the container by a forklift or the like from four directions.

In a preferred embodiment of the present invention, it is an aspect to provide a first means for securing the sleeve within the channel of the base frame. The first means for securing may comprise a plurality of connecting members on one of either the base frame or the sleeve. Such connecting members include a plurality of male connecting members on the sleeve and a plurality of corresponding female connecting members on the base frame.

It is an aspect of the invention to provide a second means for securing the sleeve within the top frame. The second means for securing may comprise a plurality of connecting members on one of either the top frame or the sleeve. Such connecting members include a plurality of male connecting members on the sleeve and a plurality of corresponding female connecting members on the top frame.

It is another aspect of the invention to provide a modular drop box container having a sleeve with at least one integral side support. The at least one integral side support in one embodiment comprises a T-fold running from one outer edge to the other in at least one sleeve sidewall. Additionally, or alternatively, the at least one integral side support may comprise double-bend comers. The sleeve may also be configured to include a plurality of fold lines allowing the sleeve to be folded and stored within the base frame when compacted.

A further aspect of the invention provides an integral support along an edge of the first pair of door panels distal to the edge of attachment and below a plane defined by the first pair of door panels. The integral support preferably comprises a means for increasing the container volume by providing a cavity defined within the integral support and being open to the container interior.

In another aspect of the invention a second pair of door panels attached to the base frame is provided. The second pair of door panels preferably includes means for preventing the second pair of doors panels from binding with the first pair of door panels during closing.

The top frame of the present invention may comprise an opening defined in a surface of the frame to allow loading of bulk material directly into the assembled container. A detachable lid for covering the opening of the top frame may also be provided with an optional means for locking the lid to the top frame.

Preferably, the components of the present invention are molded from an injection mold material such as high density polyethylene (HDPE), polypropylene, ABS, polystyrene, high impact polystyrene, polyamides, and thermoplastic polyesters, with or without additives. For structural integrity, the plastic sheet material for the sleeve may be corrugated.

These and other aspects of the present invention set forth in the appended claims may be realized in accordance with the following disclosure with particular reference to the accompanying drawings.

DESCRIPTION OF THE DRAWINGS

In the accompanying drawings forming part of the specification, and in which like numerals are employed to designate like parts throughout the same.

DETAILED DESCRIPTION OF PREFERRED EMBODIMENT

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Referring generally to the appended FIGS. 1–15, the modular drop box container of the present invention can be more readily understood. The disclosed drop box container is generally referenced by the number "10" in the following disclosure and drawings. Other components are similarly and consistently numbered throughout. While the present invention is particularly designed for use with solid baterial, such as PET preforms for plastic bottles, other types of materials, including packages of liquid, food grains, semi-solids, non-liquid material, and the like, may be suitable for use with the assembly as well.

Figure 2:
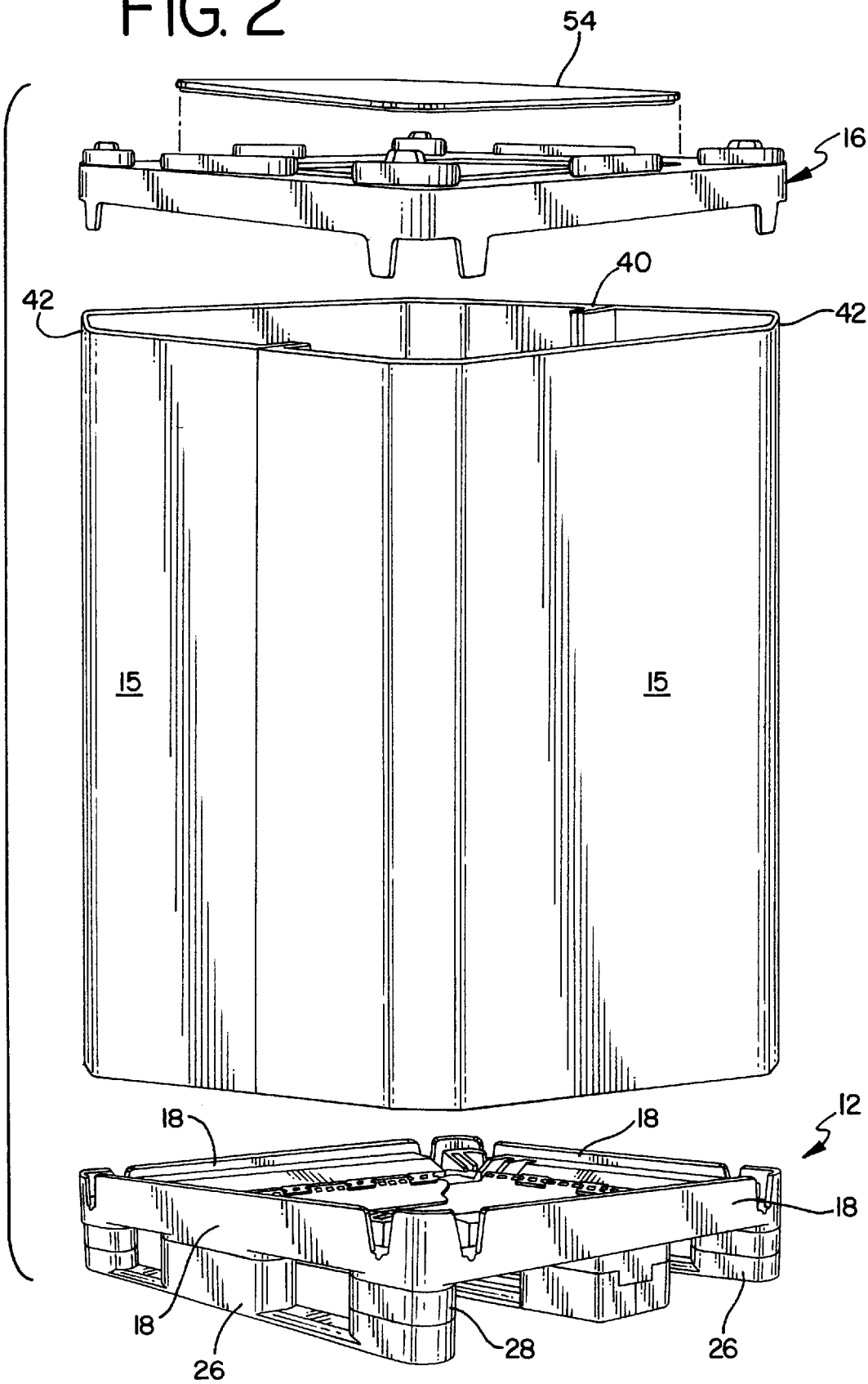
FIG. 2 is an exploded view of the embodiment of FIG. 1.
Figure 3:
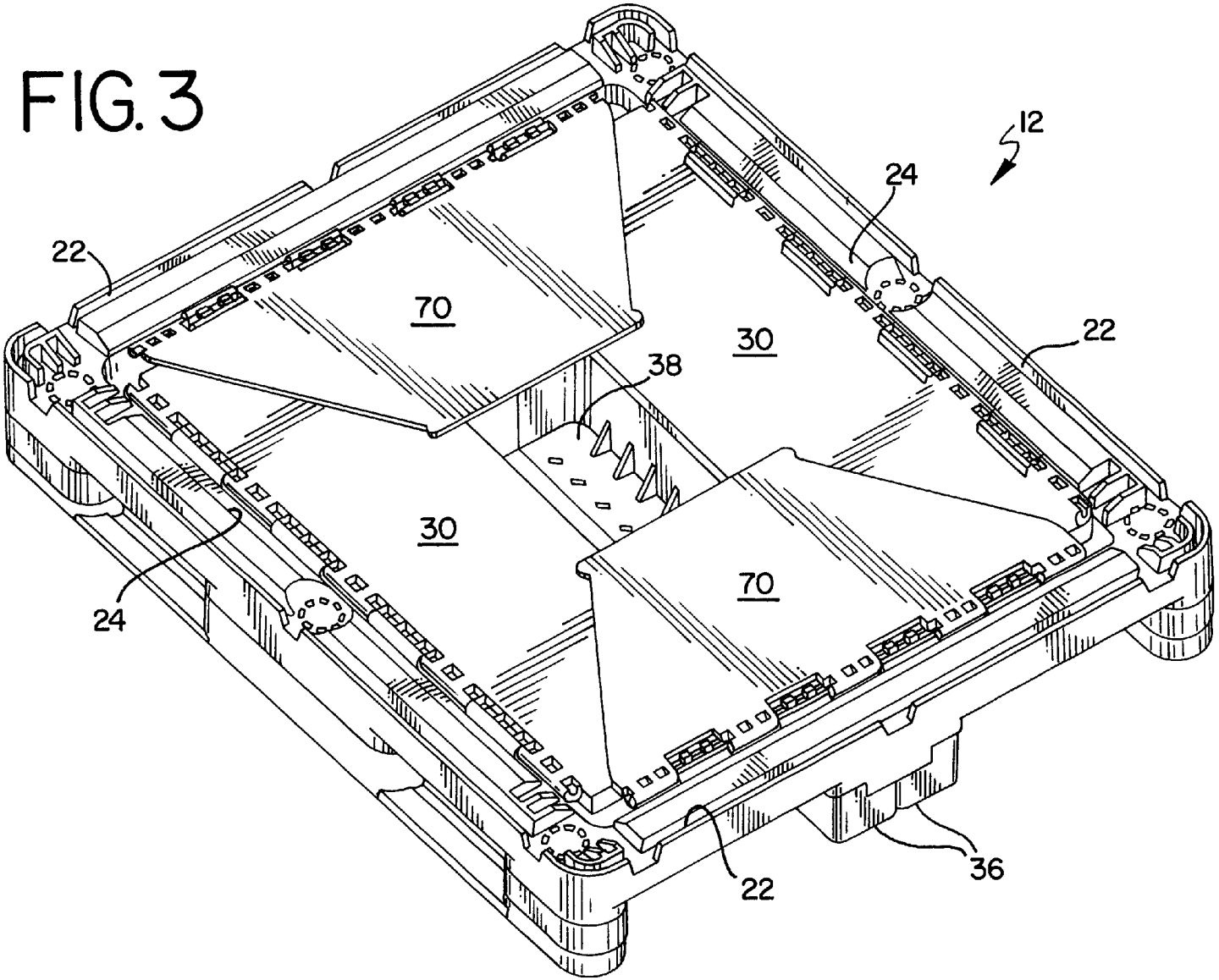
FIG. 3 is a perspective view of one embodiment of the base component.
Figure 4:
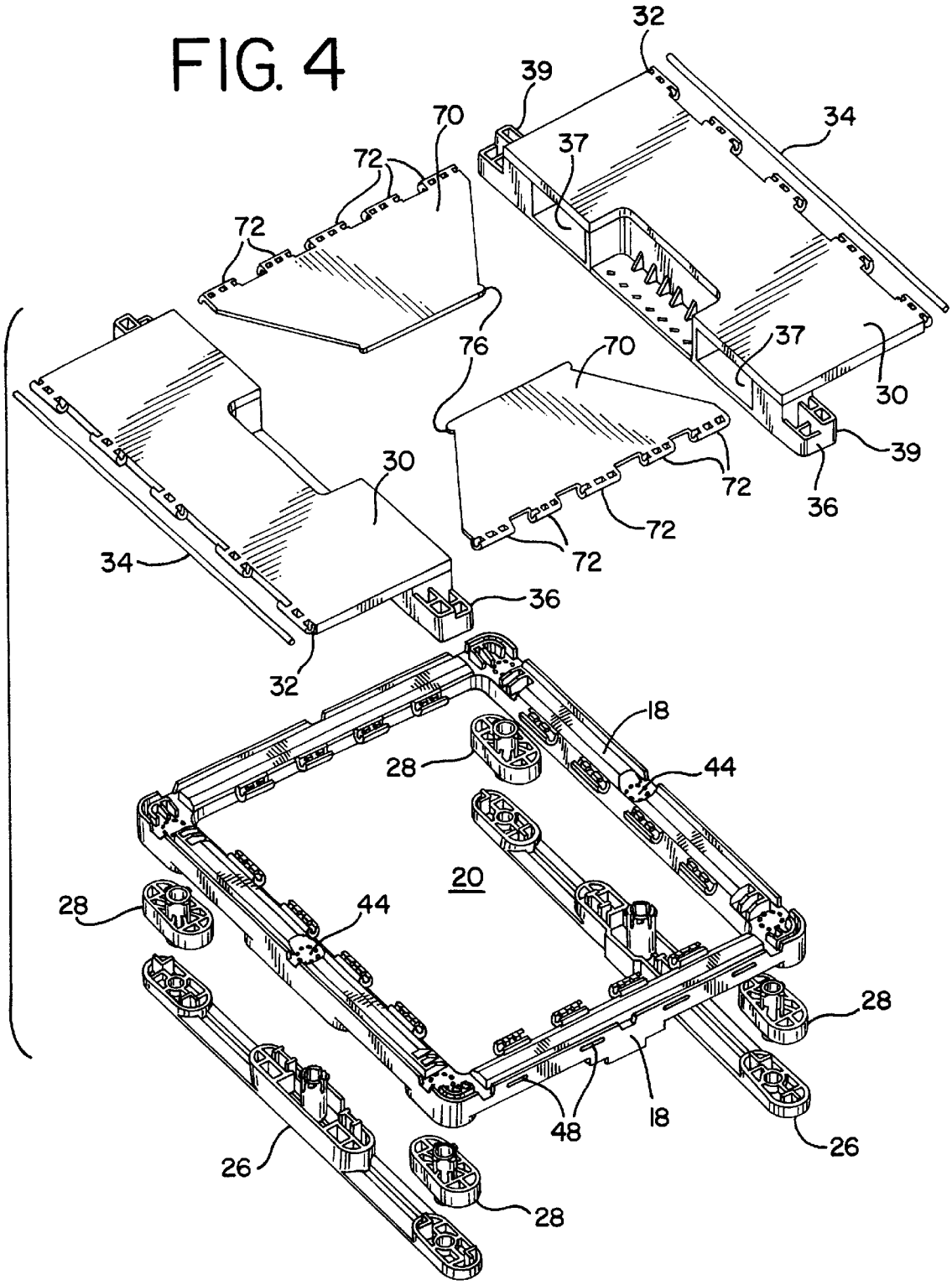
FIG. 4 is an exploded view of the base component shown in FIG. 3.
Figure 5:
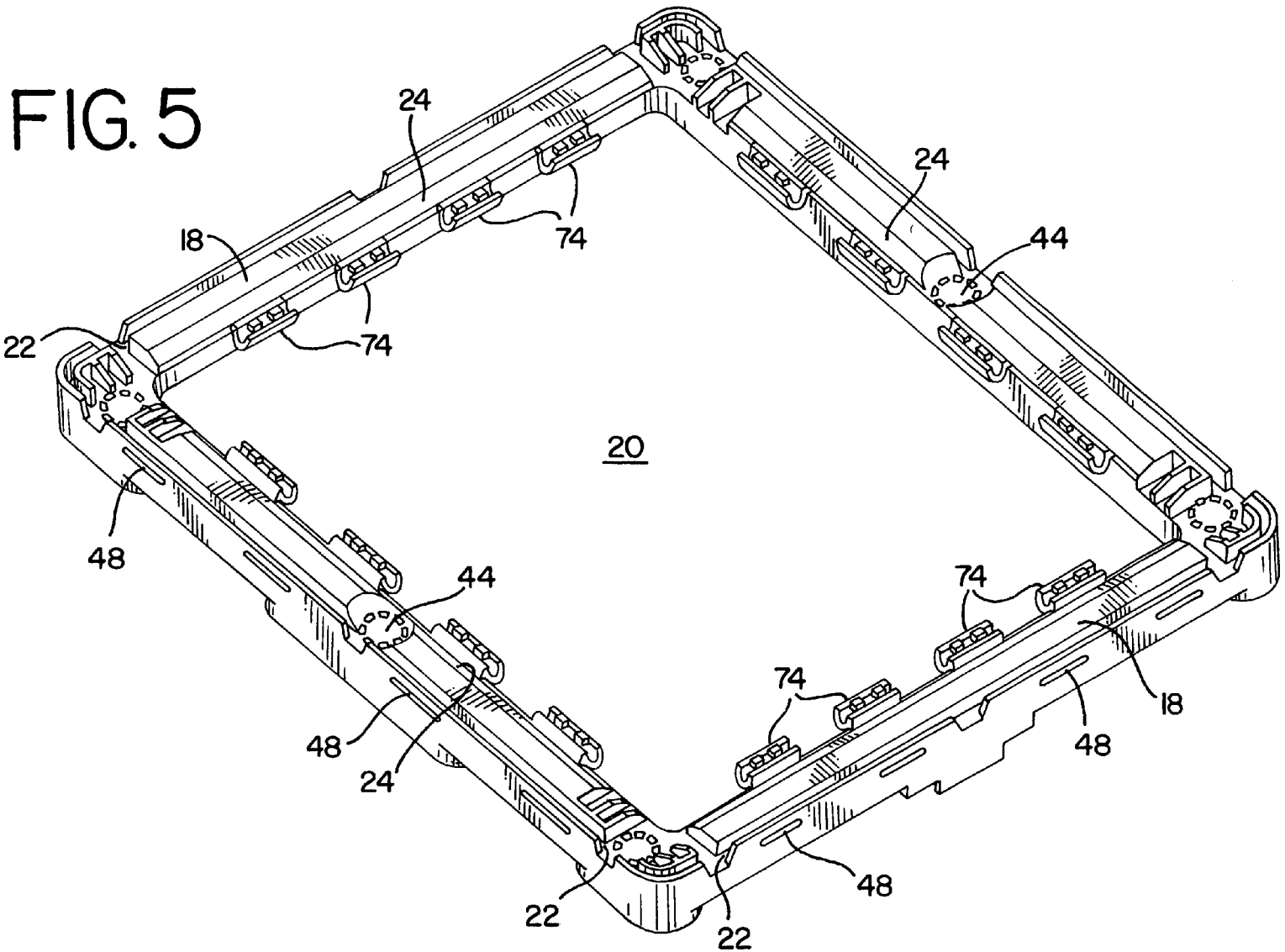
FIG. 5 is a top view of the frame of the base component shown in FIG. 4.

The presently preferred embodiment of the modular drop box container 10, as shown in FIG. 2, is comprised of three basic components: a base frame 12, a sleeve 14, and a top frame 16. The base frame 12 shown in FIGS. 3–5 is minimally constructed of a plurality of side members 18 configured to define an opening 20. The side members 18 include a channel 22 circumjacent the opening 20, and an upper surface 24 sloped away from the channel 22 and toward the opening 20. A pair of runners 26 may be optionally used along the underside of the base frame 12 to elevate the container 10 above a surface and thereby allow engagement of the container 10 by a forklift (not shown) or the like, from each of four directions. The runners 26 are attached at comers of the base frame 12 via connectors 28. Suitable connectors are the subject of several patents, including U.S. Pat. Nos. 4,843,976, 5,197,395, 5,579,686, D354,606, D378,458, D398,731, and D398,732, commonly owned by the assignee of the present invention, the relevant subject matter of each being hereby incorporated by reference. The detachable feature of the connectors 28 allows for repair or replacement of the less expensive runners 26 and connectors, without having to discard the larger container 10 or base frame 12.

The preferred base frame 12 also includes a first pair of door panels 30 (a.k.a. long doors) attached along one edge to the base frame 12 for opening and closing across the opening 20. The first pair of door panels 30 are preferably hinged along an edge of the inner surface of two opposed side members 18 and are self-aligning within the opening 20. That is, as each door panel 30 is placed within the opening 20, it is properly aligned to receive the hinge rod 34 by virtue of abutting the side members 18 along three sides and the opposite door panel 30 along the fourth side. The hinge rod 34 may then be inserted to complete the hinge 32. Preferably, the passage for the hinge rod 34 is slightly tapered to allow easy insertion, but still provide a tight friction grip on the rod 34 to prevent undesirable lateral movement.

Figure 6:
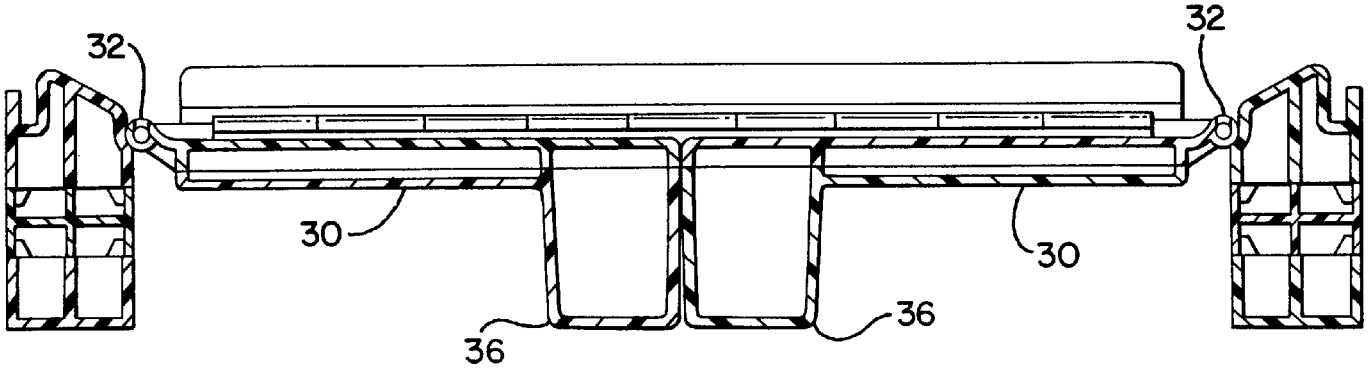
FIG. 6 is a side cross-section of the base component shown in FIG. 3 with the doors closed.
Figure 7:
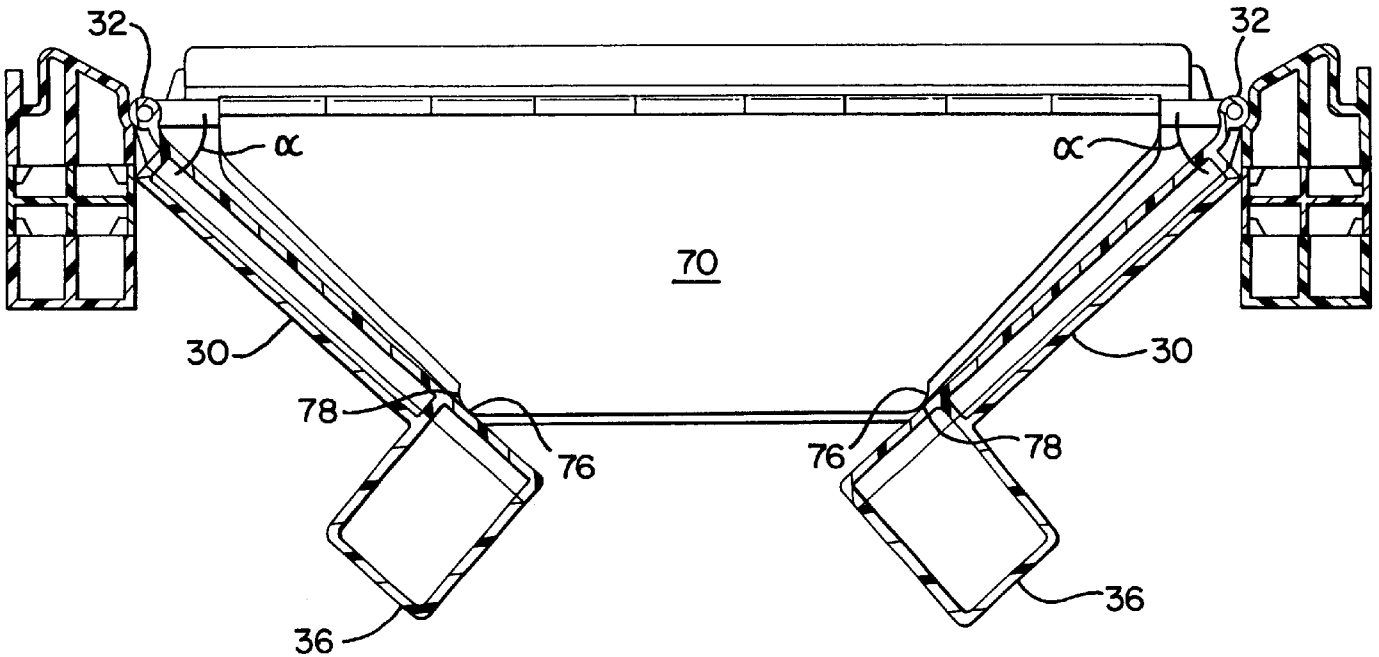
FIG. 7 is a side cross-section of the base component shown in FIG. 3 with the doors open.

Referring to FIGS. 6 and 7, the hinge 32 is also designed, in the present embodiment, to allow free swinging movement of the first pair of door panels 30, but also to terminate travel ($\alpha$) of the first pair of door panels 30 at approximately 60°. Preferably, the travel ($\alpha$) of the first pair of door panels is within the range of from about 30° to about 80°. The free swinging action allows the first pair of door panels 30 to open the instant a supporting surface, such as fork lift tines or a warehouse floor, is removed. There is no mechanical or operator action necessary to further release the door panels 30.

Figure 8A:
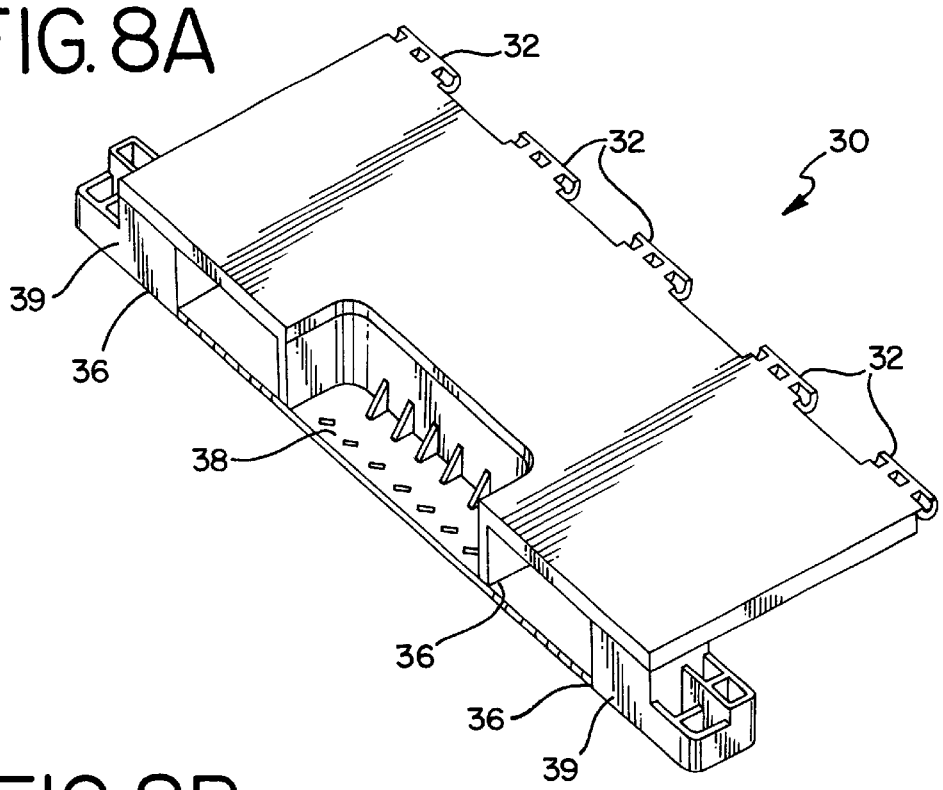
FIGS. 8A to 8C are a series of views of the long door panels of the base component shown in FIG. 4.
Figure 8B:
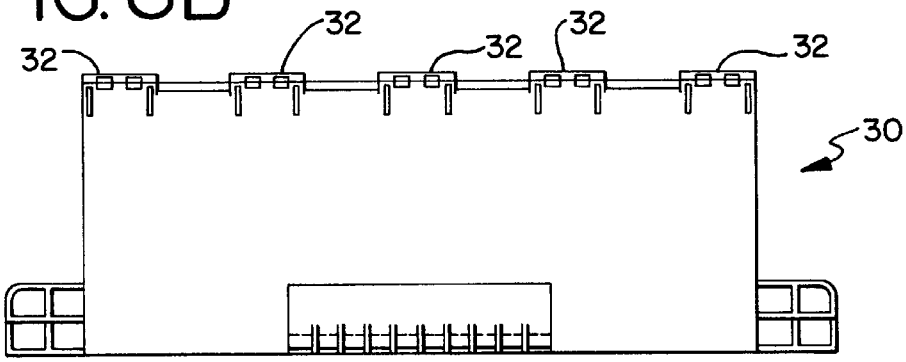
Figure 8C:
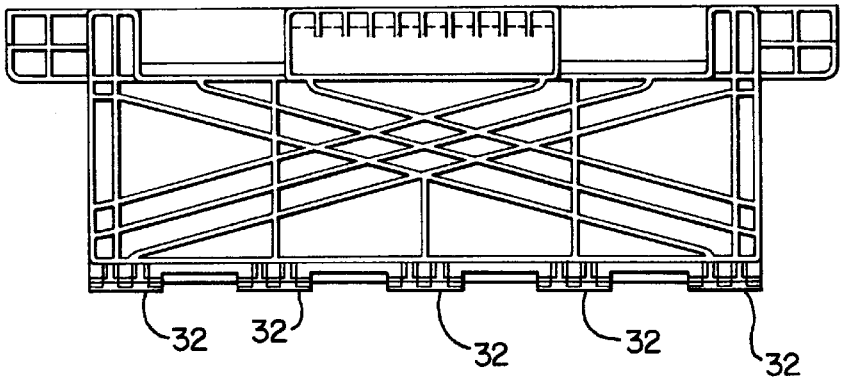

Referring now to FIG. 8, the construction of the first set of door panels 30 can be more readily understood—each door panel being a mirror image of the other. The door panel 30 of the present embodiment is a two piece construction having a top piece and bottom piece welded along a midline. An integral support footing 36 is provided on each door panel 30 below the surface of the panel door, and preferably along the edge opposite the hinge 32. The integral support footing 36 lifts the door panel 30 into a closed position (FIG. 6) when the container 10 is placed upon a surface, and holds the door panel 30 in this position as the container 10 remains on the surface.

While the support footing 36 provides partial contact to the floor or a surface underneath the door, this footing needs to be continuous across the container length in order to be used on certain types of material handling systems, such as conveyors. Therefore, like the runners 26 as shown in FIG. 4, the integral support footing 36 preferably extends the length of the base frame 12. The two openings 37 still permit access by the tines of a fork lift or the like. The footing structure which spans the openings 37 allows the door panel 30 to be biased upward on, for example, a conveyor belt which may not provide contact for the entire footing 36.

Another way of providing a continuous contact area is by having a cavity 38 extend across the full length of the door panel 30. However, material will drop out along the full length of the container instead of a limited and targeted central area. The later is achieved through the assist of the second pair of doors 70, as explained below. The preferred way of accomplishing continuous contact is by having a cavity 38 with a targeted length and adding two additional footings 39 adjacent to the cavity 38.

In order to form the hollowed area above footings 39 in the case of an injection molding process, one can build a mold with a side action—an expensive process. In the present invention, however, this area is achieved through use of a two-piece construction of each door panel 30. A top piece and a bottom piece are injection molded separately without side action and then welded together to form the cavity 38 and a continuous support footing 36. It is contemplated that other method of joining these two pieces together, such as mechanical fastening, snap fit and adhesive bonding could also be used for the construction.

When set into position, the cavity 38 may provide an increase in the container volume of from about 0.5 $ft^3$ to about 20 $ft^3$, or more. Additionally, it is believed that the contour of the cavity 38 may offer flow direction to the discharging product (See FIG. 13).

Figure 10:
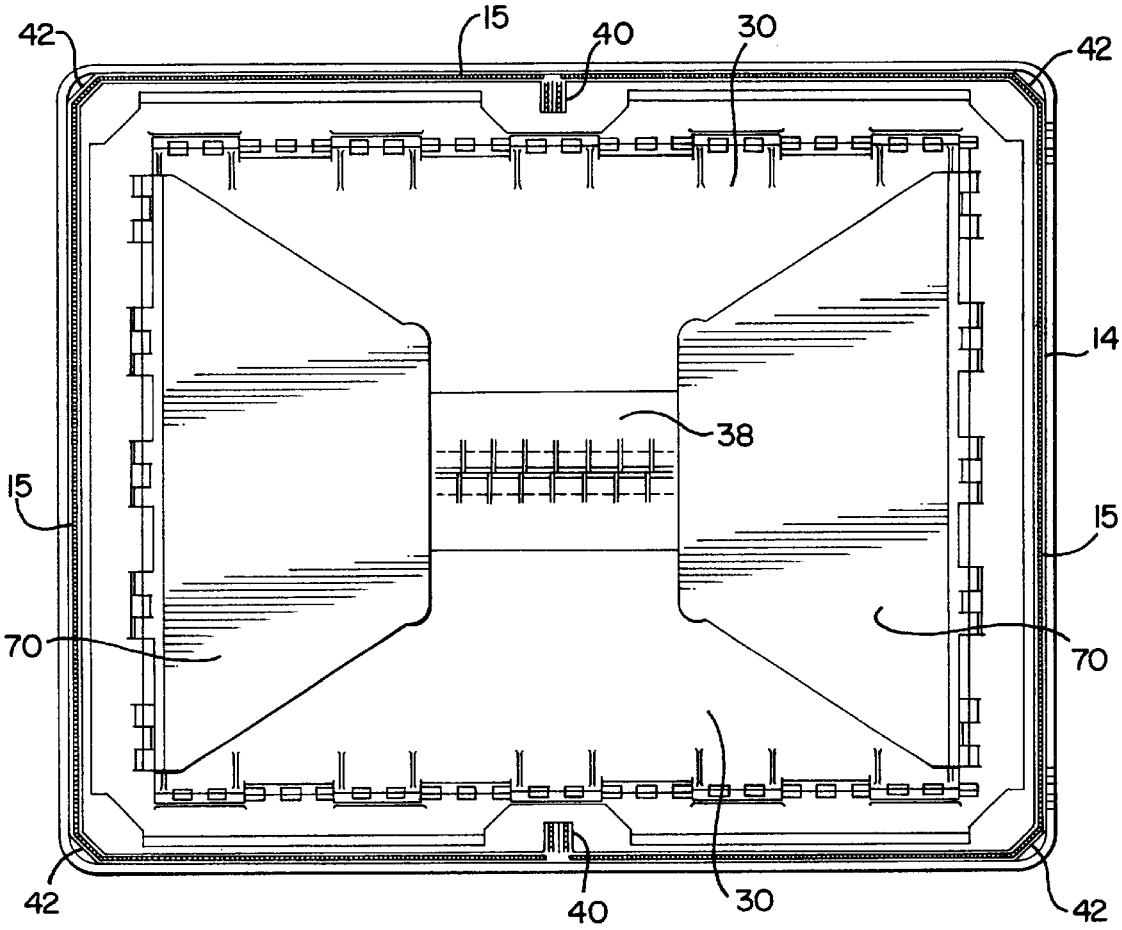
FIG. 10 is a top view of the sleeve sitting in the base component.

With reference to FIGS. 2 and 10, the sleeve 14 of the present invention can be seen. Preferably, the sleeve 14 is a four-sided continuous component providing supporting sidewalls 15 to the container 10. The height of the sleeve 14 may range from about one foot to about ten feet, depending upon the material used for the sleeve 14, with shorter sleeves providing less volume but greater structural integrity. The sleeve 14 has two open ends, each defined by an edge, either of which may be seated within the channel 22 of the base frame 12. Naturally, the four-sided embodiment is merely preferred in the industry, but several alternatively shaped assemblies, including cylindrical, would be possible utilizing the principles of the present invention.

Because the sleeve 14 must confine a large amount of bulk material within, it is designed as a corrugated plastic sheet material. Alternative embodiments for this support are too numerous to set forth in this application, but those skilled in the relevant art would be capable of readily providing such alternative support upon reading this disclosure. Additionally, when several of these containers 10 are stacked, a significant amount of weight is necessarily supported by the sleeve 14. To address this requirement, the present invention provides integral side supports. These integral side supports provide a rigid rib or rib-like structure along the sleeve sidewalls 15, as necessary. In the present embodiment the supports come in the form of "T" folds 40 running from one edge of the sidewalls 15 of the sleeve 14 to the other edge, as well as double-bend comer folds 42, as shown in FIG. 10. Naturally, other structural configurations may be used, including vertical metal or plastic rods, bars, or the like, folds of various designs, and horizontal structures spanning from one sidewall to another, as well.

The "T" folds 40 may be in one sidewall 15, opposing sidewalls 15, or all the sidewalls 15 of the sleeve 14. Additionally, returning to the drawing of FIG. 5, when seating the sleeve 14 within the channel 22 of the base frame 12, special notches 44 must be made in the channel 22 to correspond to the "T" folds 40. Similarly, for the double-bend comer folds 42, the channel 22 must make accommodations to allow a fit between the two components.

Figure 11:
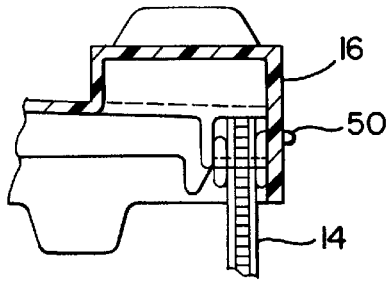
FIG. 11 is a partial side view of the sleeve edge where a clip is attached.

To further facilitate the retention of the sleeve 14 within the channel 22 of the base frame 12, means for securing the sleeve are provided. Referring to FIG. 11, the preferred means for securing is a plurality of connecting members 46 on the base frame 12 and the sleeve 14. Preferably, female connecting members or slots 48 are spaced along a surface of the base frame 12, while male connecting members or clips 50 are similarly and correspondingly spaced along the surface of the sleeve 14 proximate an edge. Other possible configurations for the means for securing would include straps, tabs, buckles, clips, flanges, snaps, buttons, hooks, clasps, pins, hook-and-loop, and the like. Because each end of the sleeve 14 would be so equipped—in order to maintain the invertible aspect of the sleeve 14—the top frame 16, which covers the opposite open end of the sleeve 14, should be similarly configured.

Figure 1:
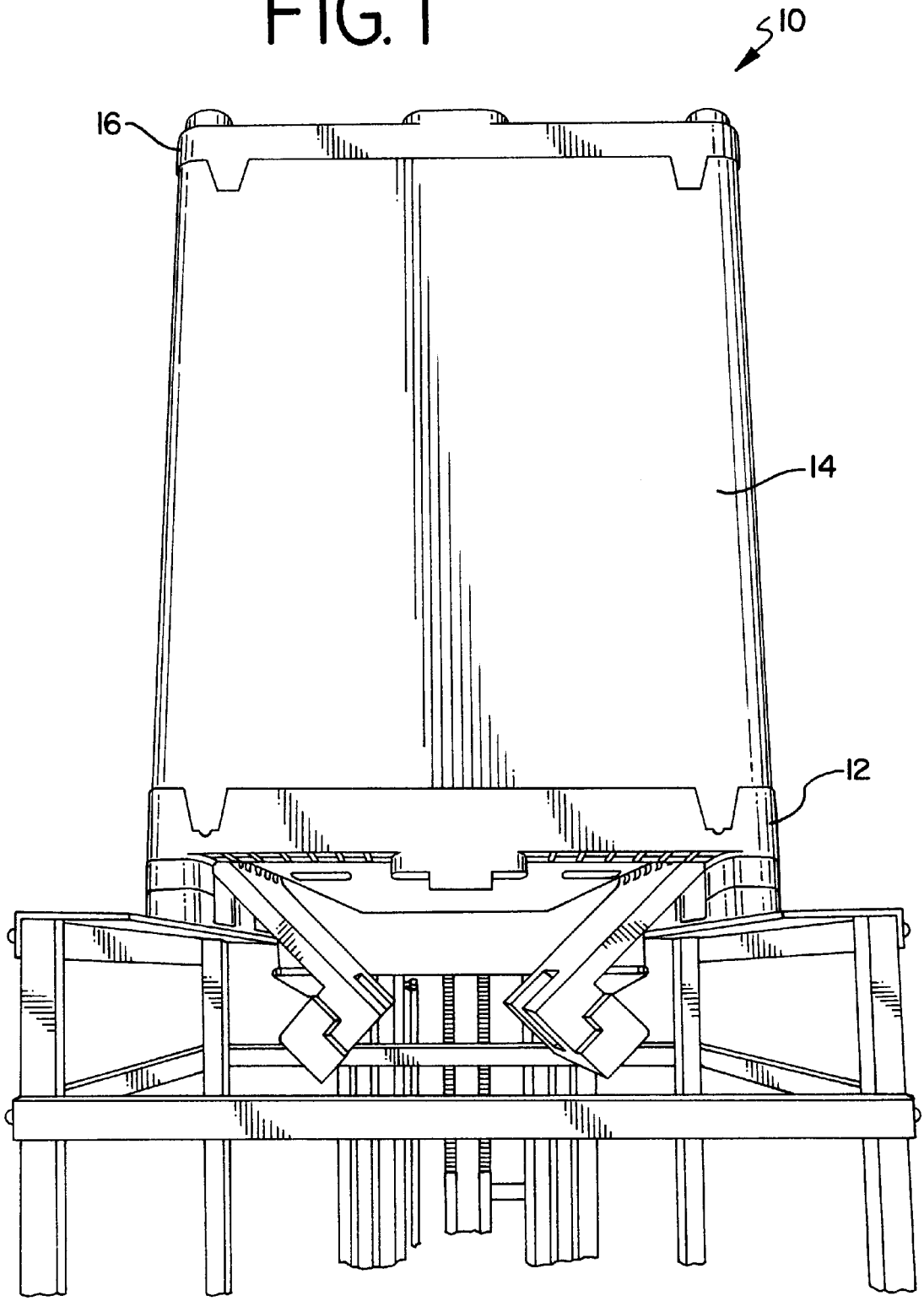
FIG. 1 is a side perspective view showing one embodiment of the present invention assembled and opened at the bottom.
Figure 12:
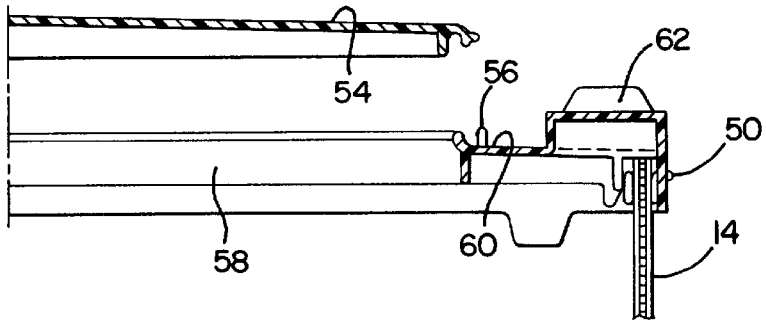
FIG. 12 is an exploded view of one embodiment of the top component and lid.
Figure 13:
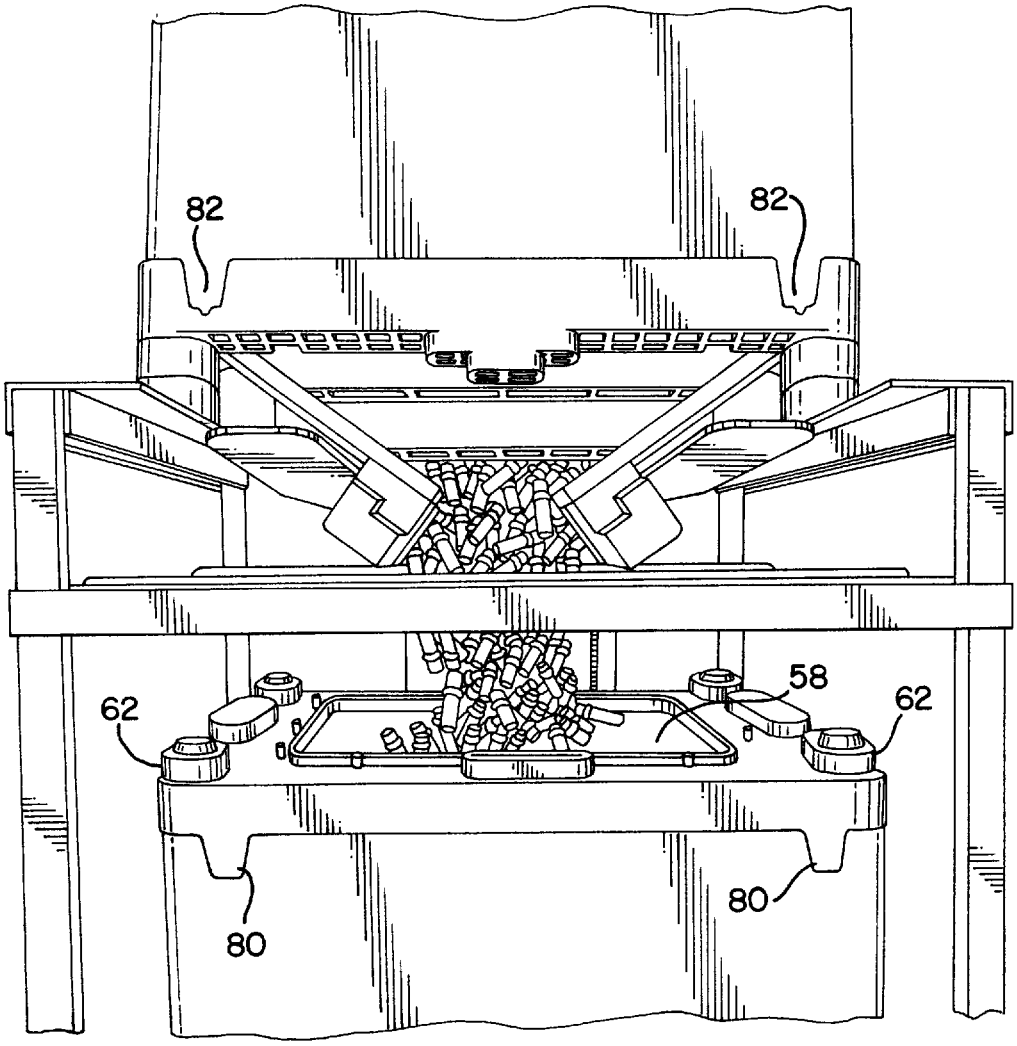
FIG. 13 is a perspective view of two containers in use.

The top frame 16, as shown in FIGS. 1 and 2, covers the other open end of the sleeve 14 to thereby form the assembled container 10. FIG. 12 shows the sleeve 14 being secured within a channel 52 of the top frame 16, as discussed previously. Also shown is a lid 54 which fastens onto the top frame 16 via clips 56. Naturally, numerous other fastening arrangements are possible, including hinges (not shown) of various designs. The lid 54 is removable from the top frame 16 to expose an opening 58 within the surface. The opening 58 allows the assembled container 10 to be filled with bulk materials as illustrated in FIG. 13. This aspect of the present embodiment is helpful, since the other major components provide structural integrity to the container 10 during filling and may be difficult to secure in place after filling.

The top frame 16 is also preferably configured to permit stacking of containers 10. The top surface 60 of top frame 16 allows seating of the underside components of the base frame 12. That is, the raised portion 62 of the top frame 16 is configured to engage and retain the runner 26 or the base frame 12 itself in a stable manner.

Referring to FIG. 3, a pair of short door panels 70 are shown to be hinged transverse to the first door panels 30. The hinged connection is accomplished in this embodiment without the use of a hinge rod—as used with the first pair of door panels 30. The hinge 72 of the short door panels 70 preferably snaps into a corresponding hinge receptacle 74 (FIG. 4). The short door panels 70 provide directional assistance to the discharging bulk material. Without the short door panels 70 the present container 10 would discharge its contents along the full length of the first door panels 30, thus allowing the possibility for such material to spill out the sides and onto, for example, a warehouse floor. The short door panels 30 prevent this side discharge and thereby minimize spillage.

Figure 9A:
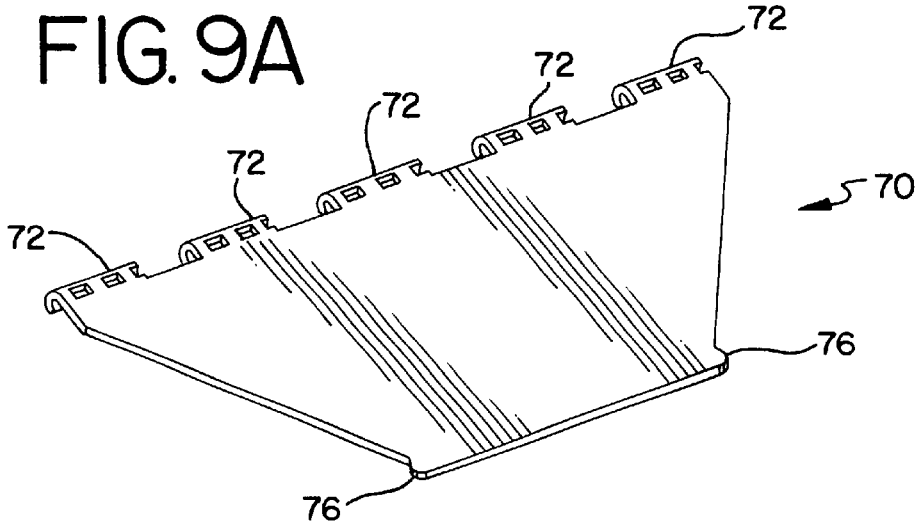
FIGS. 9A to 9C are a series of views of the short door panels of the present invention.
Figure 9B:
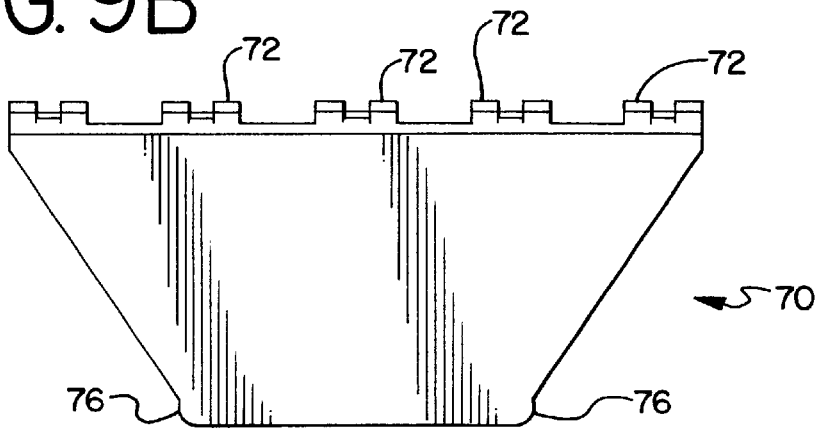
Figure 9C:
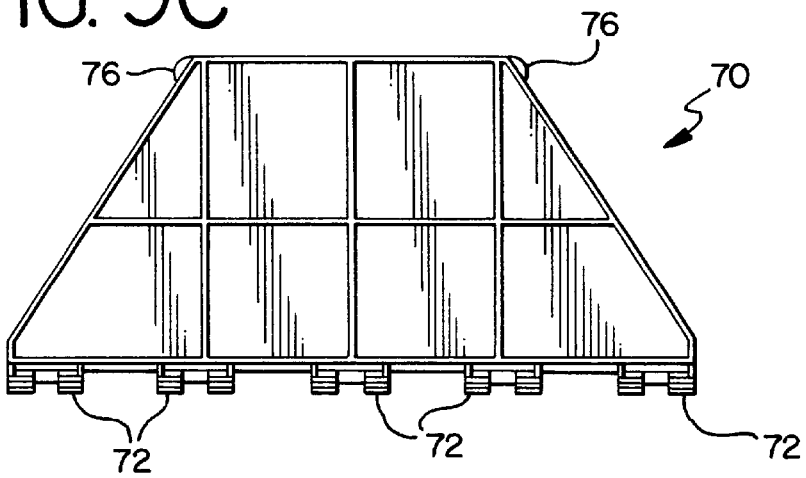

As shown in FIGS. 9A–9C, the short door is generally trapezoidal with hinges 72 along the longest side. At the comers of the short side is shown two knobs or protuberances 76. The protuberances 76 provide a single contact point 78 on each first door panel 30 in an open position, as illustrated best in FIG. 7. Naturally, the protuberance 76 may be of a variety of differing sizes or shapes to provide the necessary single point contact. As the first door panels 30 are biased upward (by a surface or forklift tines), the protuberances 76 maintain contact with the first door panels 30 and prevent binding the door panels 30 and 70 during the closing process.

Figure 14:
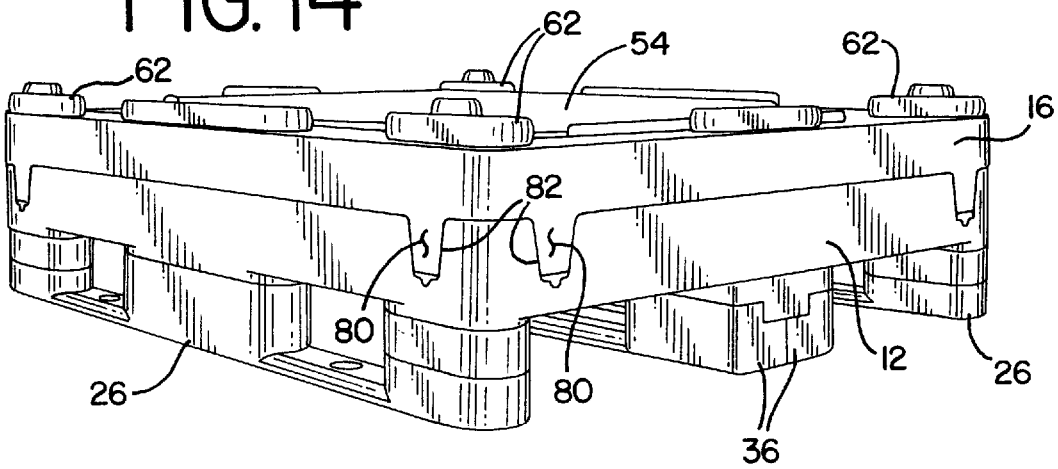
FIG. 14 is a perspective view of one embodiment of the present invention as an empty collapsed container for return shipment.

Finally, referring to FIG. 14, the present container 10 embodiment is capable of being compacted when empty. This feature allows storage of the container 10, return shipping of the container 10, or any similar operation, to be space efficient. The base frame 12 and the top frame 16 are provided with alignment members to make compaction easier. The alignment members, in the present embodiment, comprise tabs 80 extending perpendicular to the top surface of the top frame 16 and corresponding slots 82 in the perimeter of the base frame 12. Upon compaction, the tabs 80 of the top frame 16 fit into the slots 82 of the base frame 12. Further, with sleeves 14 of lesser height (i.e., those less than the length of the base frame 12), the double-bend corners 42 and "T" folds 40 provide fold lines for compacting the sleeve to fit within the base frame 12 when compacted. The taller sleeves 14 could still be folded along the designated fold lines, but would not be capable of storage within the compacted frame.

It is a preferred embodiment that each of the components of the present invention be made from an injection molded plastic and process. Possible materials for use are not limited to high density polyethylene (HDPE), polypropylene, ABS, polystyrene, high impact polystyrene, polyamides, and thermoplastic polyesters, with or without additives. These and other such materials provide a durable and structurally strong, yet lightweight container 10 for use in the shipping industry.

Figure 15:
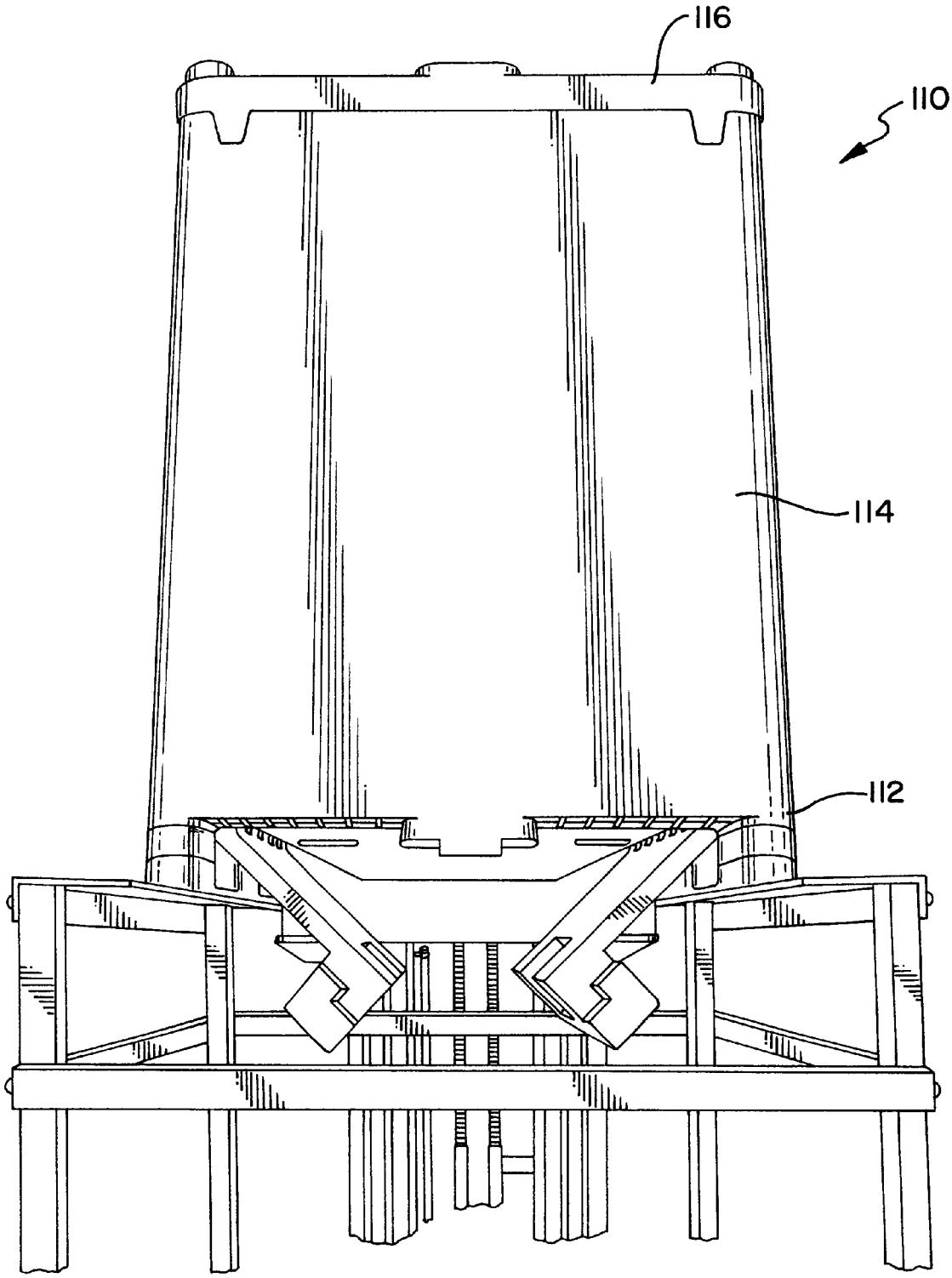
FIG. 15 is a side perspective view showing an alternative single-piece embodiment of the present invention assembled and opened at the bottom.

Referring to FIG. 15, an alternative embodiment is shown. Container 110 is comprised of a single piece base and sidewall construction. This would eliminate the use of securing means to retain a sleeve within a base frame. As a single piece construction, the base 112 includes many of the features of the previous embodiment, such as the sloped inner surface, the automatic doors, the integral support, as well as others. The use of a top frame 116 is optional for this embodiment, depending upon the rigidity of the sidewall 114. Less firm or rigid sidewalls may require the support provided by the addition of the top frame 116. Additional support structures, as previously discussed, may be incorporated into the sidewall 114 to improve the rigidity component, if necessary.

Figure 16:
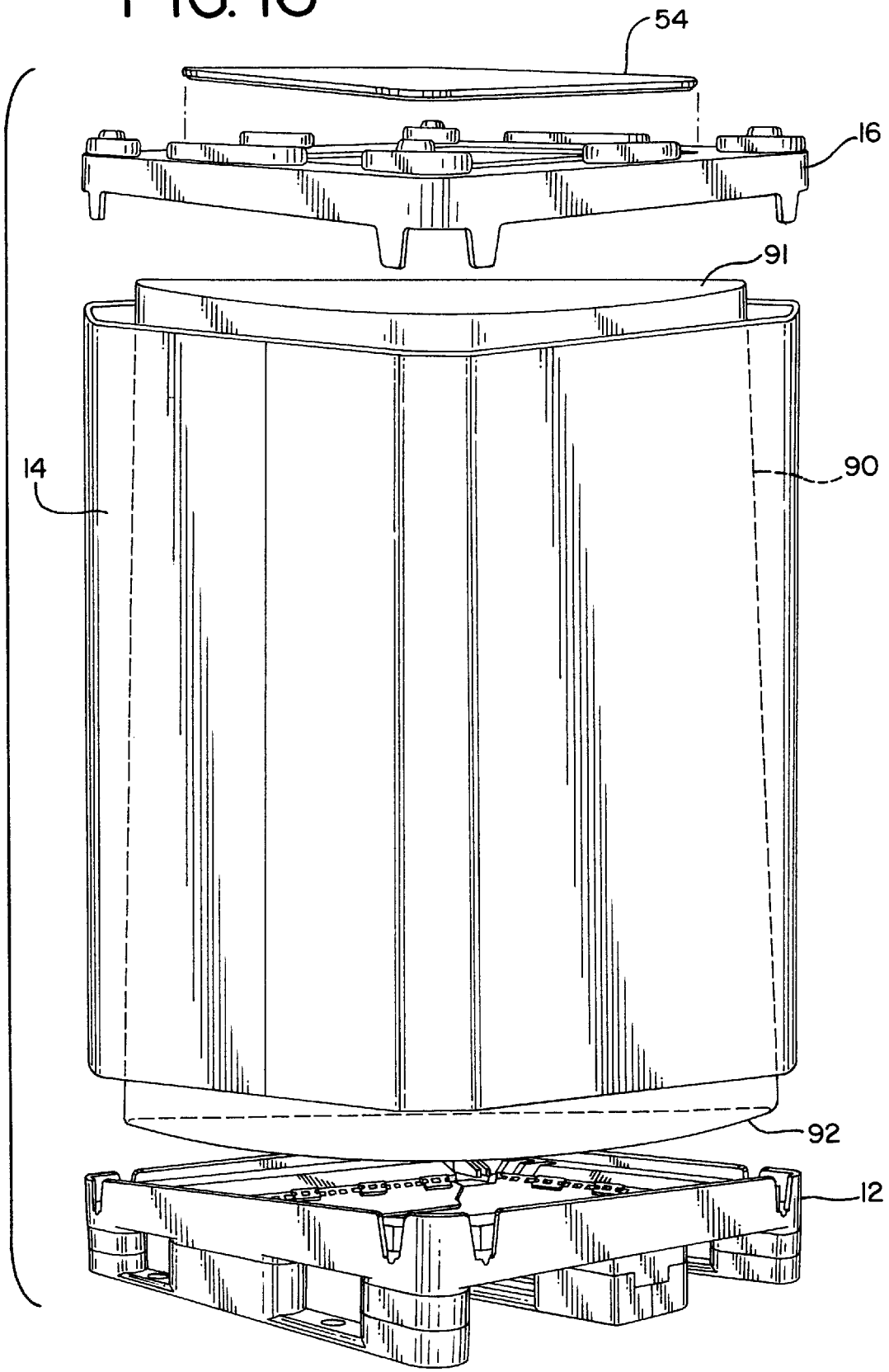
FIG. 16 is an exploded view of the alternative embodiment having the basic components of the embodiment shown in FIG. 1, but also including an inner liner for use with very small, powered, or even liquid materials.

In still another alternate embodiment, shown in FIG. 16, an inner liner 90 can be used with the present invention to assist in the storage of very small, powdered, or even liquid materials. In particular, the inner liner 90 can be a tubular bag, like a cylindrical or rectangular plastic bag with openings at both the top 91 and bottom 92. The liner 90 can be positioned within the sleeve 14 between the top frame 16 and the base frame 12. By making the liner 90 longer than the height of the sleeve 14, it can be folded at the bottom 92 or otherwise closed to prevent leaking of the bulk material. The weight of the material in the sleeve 14 will help to retain the closure of the liner 90. With liquid material a heat sealed closure may be desirable, but would require an additional step to break the seal at discharge.

At the top frame 16, liner 90 can be folded at the top 91 or attached to the lid 54 or top frame 16. In this manner, the small, powdered, or liquid material can be readily placed into the liner 90 through the opening 58. The liner 90 can then be closed on the bottom, as described above, and closed on the top, through a separate closure (not shown) or by closing the lid 54. When the door panels 30 are opened, the -liner 90 also opens at the bottom 92, releasing the contents of the liner 90. To prevent the liner 90 from being discharged with the bulk material, it is preferable to attach it to the sidewalls 15 of sleeve 14. It is contemplated that the disclosed liner 90 may be reusable or disposable for one-time uses.

While specific embodiments have been illustrated and described, numerous modifications are possible without departing from the spirit of the invention, and the scope of protection is only limited by the scope of the accompanying claims.

We claim:

1. A modular drop box container for bulk items comprising:

a base frame having a plurality of side members configured to define an opening, a channel seated within the side members and circumjacent the opening, and wherein an upper surface of each side member is sloped away from the channel and toward the opening;

at least one runner to elevate the base frame from a surface and thereby allow engagement of the container by a forklift or the like;

at least one door panel attached along one edge to the base frame for opening and closing across the opening; and a sleeve having a plurality of sidewalls and two outer edges defining opposed open ends with one outer edge configured to be seated within the channel of the side members of the base frame to cover the open end.

2. The modular drop box container of claim 1, wherein the sleeve comprises a plurality of fold lines allowing the sleeve to be folded and stored within the base frame when compacted.

3. The modular drop box container of claim 1, wherein the sleeve comprises a plurality of connecting members for securing to the base frame.

4. The modular drop box container of claim 1, wherein the base frame and the at least one first door panel are made from an injection molded plastic.

5. The modular drop box container of claim 1, further comprising a top frame for covering the other open end of the sleeve and thereby forming a closed container.

6. The modular drop box container of claim 5, further comprising a second means for securing the sleeve within the top frame.

7. The modular drop box container of claim 6, wherein the second means for securing comprises a plurality of connecting members on one of either the top frame or the sleeve.

8. The modular drop box container of claim 6, wherein the second means for securing comprises a plurality of male connecting members on the sleeve and a plurality of corresponding female connecting members on the top frame.

9. The modular drop box container of claim 5, wherein the top frame comprises a channel configured to engage the edge of the sleeve.

10. The modular drop box container of claim 5, wherein the top frame comprises an opening defined in a surface of the frame.

11. The modular drop box container of claim 10, wherein the top frame further comprises a detachable lid for covering the opening of the top frame.

12. The modular drop box container of claim 11, wherein the top frame comprises means for locking the detachable lid to the top frame.

13. The modular drop box container of claim 5, further comprising alignment members between the base frame and the top frame.

14. The modular drop box container of claim 13, wherein the alignment members comprise tabs and slots on the base frame and the top frame, with the tabs fitting into the slots during compaction of the container.

15. The modular drop box container of claim 1, further comprising a first means for securing the sleeve within the channel of the base frame.

16. The modular drop box container of claim 15, wherein the first means for securing comprises a plurality of connecting members on one of either the base frame or the sleeve.

17. The modular drop box container of claim 16, wherein the first means for securing comprises a plurality of male connecting members on the sleeve and a plurality of corresponding female connecting members on the base frame.

18. The modular drop box container of claim 17, further comprising a second means for securing the sleeve within a top frame used for covering the other open end of the sleeve, and wherein the second means for securing comprises a plurality of male connecting members on the sleeve and a plurality of corresponding female connecting members on the top frame such that either open end of the sleeve may be secured within either the top frame or the base frame.

19. The modular drop box container of claim 1, wherein the sleeve comprises at least one integral side support between adjacent sidewalls.

20. The modular drop box container of claim 19, wherein the at least one integral side support comprises double-bend comers between adjacent sidewalls.

21. The modular drop box container of claim 19, wherein the at least one integral side support comprises a T-fold running from one outer edge to the other in at least one sleeve sidewall.

22. The modular drop box container of claim 21, wherein the at least one integral side support comprises a T-fold running from one outer edge to the other in two sleeve sidewalls.

23. The modular drop box container of claim 21, wherein the at least one integral side support comprises a T-fold running from one outer edge to the other in each sleeve sidewall.

24. The modular drop box container of claim 21, wherein the at least one integral side support further comprises double-bend comers between adjacent sidewalls.

25. The modular drop box container of claim 1, further comprising an integral support along an edge of the first pair of door panels distal to the edge of attachment and below a plane defined by the first pair of door panels.

26. The modular drop box container of claim 25, wherein the integral support comprises a means for increasing the container volume.

27. The modular drop box container of claim 26, wherein the means for increasing the container volume comprises a cavity defined within the integral support and being open to the container interior.

28. The modular drop box container of claim 27, wherein the cavity has a volume within the range of from about 0.5 $ft^3$ to about 20 $ft^3$.

29. The modular drop box container of claim 1, further comprising at least one second door panel attached to the base frame for opening and closing across the opening, wherein the at least one second door panel comprises means for preventing the second door panels from binding with the at least one first door panel during closing.

30. The modular drop box container of claim 29, wherein the means for preventing comprises only a single contact point between the each of the second door panels and each of the first door panels.

31. The modular drop box container of claim 30, wherein the means for preventing comprises a protrusion along an edge of each second door panel contacting a first door panel.

32. The modular drop box container of claim 31, wherein each second door panel has a protrusion on each of two edges.

33. The modular drop box container of claim 1, wherein the sleeve is collapsible.

34. The modular drop box container of claim 33, wherein the collapsible sleeve is made from a plastic sheet material.

35. The modular drop box container of claim 34, wherein the plastic sheet material is corrugated.

36. The modular drop box container of claim 33, wherein the collapsible sleeve comprises a plurality of panels joined together.

37. The modular drop box container of claim 1, further comprising an inner liner having an opening at two opposing ends and positioned within the sleeve.

38. The modular drop box container of claim 37, wherein the inner liner is attached to at least one sidewall of the sleeve to prevent discharge of the liner.

39. The modular drop box container of claim 37, wherein one open end of the inner liner attaches to an open end of the sleeve.

40. The modular drop box container of claim 37, wherein one open end of the inner liner folds up adjacent the at least one door panel.

* * * * *

UNITED STATES PATENT AND TRADEMARK OFFICE

CERTIFICATE OF CORRECTION

PATENT NO. : 6,416,271 B1
DATED : July 9, 2002
INVENTOR(S) : Maurice J. Pigott et al.

It is certified that error appears in the above-identified patent and that said Letters Patent is hereby corrected as shown below:

Column 2,
Line 31, delete “comers” and insert the word -- corners -- therefor

Column 3,
Line 38, delete “powered” and insert the word -- powdered -- therefor
Line 55, delete “bacterial” and insert the words -- bulk material -- therefor Column 4,
Line 6, delete “comers” and insert the word -- corners -- therefor Column 5,
Lines 52 and 63, delete “comer” and insert the word -- corner -- therefor Column 9,
Lines 16 and 31, delete “comers” and insert the word -- corners -- therefor Signed and Sealed this Fifteenth Day of April, 2003

JAMES E. ROGAN
*Director of the United States Patent and Trademark Office*